US008616841B2

(12) United States Patent
Johnson

(10) Patent No.: US 8,616,841 B2
(45) Date of Patent: Dec. 31, 2013

(54) DIFFUSER

(75) Inventor: Mark Andrew Johnson, Malmesbury (GB)

(73) Assignee: Dyson Technology Limited, Malmesbury (GB)

( * ) Notice: Subject to any disclaimer, the term of this patent is extended or adjusted under 35 U.S.C. 154(b) by 915 days.

(21) Appl. No.: 12/707,435

(22) Filed: Feb. 17, 2010

(65) Prior Publication Data

US 2010/0215489 A1 Aug. 26, 2010

(30) Foreign Application Priority Data

Feb. 24, 2009 (GB) ..... 0903056.0

(51) Int. Cl.
*F01D 1/02* (2006.01)

(52) U.S. Cl.
USPC ..... 415/208.3; 415/211.2

(58) Field of Classification Search
USPC ..... 415/182.1, 208.1, 208.2, 208.3, 208.4, 415/211.2, 199.2
See application file for complete search history.

(56) References Cited

U.S. PATENT DOCUMENTS

| | | | | |
|---|---|---|---|---|
| 3,424,372 | A | 1/1969 | Blattner et al. | |
| 4,824,325 | A | 4/1989 | Bandukwalla | |
| 2003/0021677 | A1 | 1/2003 | Masutani | |
| 2004/0126230 | A1 * | 7/2004 | Baldassarre et al. | 415/208.2 |
| 2004/0238691 | A1 * | 12/2004 | Hipsky | 244/135 R |

FOREIGN PATENT DOCUMENTS

| | | | |
|---|---|---|---|
| EP | 1297772 | * | 6/2002 |
| EP | 1 431 586 | | 6/2004 |
| JP | 61-252897 | | 11/1986 |
| JP | 63-36078 | | 2/1988 |
| JP | 2-24097 | | 2/1990 |
| JP | 2004-68723 | | 3/2004 |
| JP | 2005-98244 | | 4/2005 |

OTHER PUBLICATIONS

GB Search Report dated Jun. 1, 2009, directed to counterpart GB Application No. 0903056.0; 1 page.

* cited by examiner

*Primary Examiner* — Edward Look
*Assistant Examiner* — Maxime Adjagbe
(74) *Attorney, Agent, or Firm* — Morrison & Foerster LLP

(57) ABSTRACT

A diffuser that includes a plurality of radial vanes having a blade count of between 15 and 20, a solidity of between 0.6 and 0.8, and a radius ratio of vane inlet to impeller outlet of less than 1.5. Additionally, a compressor that incorporates the diffuser.

14 Claims, 3 Drawing Sheets

DIFFUSER

REFERENCE TO RELATED APPLICATIONS

This application claims the priority of United Kingdom Application No. 0903056.0, filed Feb. 24, 2009, the entire contents of which are incorporated herein by reference.

FIELD OF THE INVENTION

The present invention relates to a diffuser for a centrifugal compressor, and to a centrifugal compressor incorporating the same.

BACKGROUND OF THE INVENTION

A diffuser converts kinetic energy of fluid exiting an impeller into static pressure. The diffuser ideally provides good pressure recovery over the full range of flow angles under which the compressor operates. Vaned diffusers provide excellent pressure recovery but over a limited operating range only. Vaneless diffusers, on the other hand, have a broad operating range but provide only modest pressure recovery.

Certain appliances may experience a wide range of loads and flow rates. For example, a vacuum cleaner may experience flow rates of between 5 and 35 l/s as the cleaner is manoeuvred over different floor surfaces. Generally, however, the motor speed for these appliances is relatively slow, typically below 50 krpm. At these relatively low speeds, changes in flow rate effect only modest changes in the flow angle. Consequently, even though the appliance experiences a wide range of flow rates, the operating range is relatively small. However, as advances in motor technology lead to smaller and faster motors, the influence of flow rate on flow angle becomes an increasing problem. At speeds of around 100 krpm, even a modest change in flow rate can effect a relatively large change in flow angle. There is therefore a growing need for diffusers that can provide good pressure recovery over a relatively broad operating range.

Variable-geometry diffusers employ vanes having a stagger angle that varies with flow angle. By varying the geometry of the vanes in response to changes in flow, the diffuser can provide good pressure over a broad operating range. However, variable-geometry diffusers are expensive, require complex control, and are more prone to failure due to the presence of moving parts.

SUMMARY OF THE INVENTION

In a first aspect, the present invention provides a diffuser comprising a plurality of radial vanes having a blade count of between 15 and 20, a solidity of between 0.6 and 0.8, and a radius ratio of vane inlet to impeller outlet of less than 1.5.

With this particular selection of values, the diffuser provides positive, stall-free pressure recovery over a relatively broad range of flow angles. Moreover, the geometry of the vanes is fixed and thus the diffuser is cheaper and more robust than an equivalent variable-geometry diffuser. In providing positive, stall-free pressure recovery over a relatively broad operating range, the diffuser is ideally suited for use in high-speed compressors (i.e. operating at speeds in excess of 80 krpm), which are required to operate under a range of loads and flow rates.

The solidity is preferably between 0.6 and 0.8 and more preferably between 0.60 and 0.65. With this particular selection of values, the diffuser provides positive, stall-free pressure recovery over a flow angle range of about 20 degrees.

The radius ratio is preferably less than 1.2 and is more preferably 1.1. This then has the advantage of providing a more compact diffuser.

The vanes are ideally two-dimensional aerofoils, preferably having a lift co-efficient of 1.2. This then gives a positive pressure recovery coefficient over the complete operating range required.

The vanes advantageously have a stagger angle of between 50 and 65 degrees. The diffuser is then ideally suited for use in a high-speed compressor for which the speed of rotation and backsweep of the impeller results in a flow angle at the impeller exit of between 50 and 65 degrees at an upper flow rate.

The diffuser preferably comprises a hub, a perimeter wall that encircles the hub and a plurality of axial vanes. The radial vanes are then provided on an upper surface of the hub, and the axial vanes extend between the hub and the perimeter wall. This then has the advantage of providing a diffuser with an axial outlet. Moreover, the axial vanes provide further pressure recovery. In having a perimeter wall, a shroud may be made to cover the diffuser so as to create a fluid passageway between the inlet of the shroud and the outlet of the diffuser.

In a second aspect, the present invention provides a diffuser comprising a plurality of radial vanes providing positive, stall-free pressure recovery over a range of angles-of-attack of between 0 and 20 degrees.

The diffuser thus provides positive, stall-free pressure recovery over a relatively broad operating range through the use of fixed-geometry vanes.

Preferably, the vanes provide minimum pressure loss at an angle-of-attack of about 8 degrees. The diffuser is therefore most efficient at a point approximately at the centre of the operating range.

In a third aspect, the present invention provides a compressor comprising an impeller and a diffuser, wherein the compressor operates between a lower flow rate and an upper flow rate, fluid exits the impeller at a first flow angle at the lower flow rate and at a second flow angle at the upper flow rate, and the diffuser comprises a plurality of radial vanes having a blade count of between 15 and 20, a solidity of between 0.6 and 0.8, and a radius ratio of vane inlet to impeller outlet of less than 1.5.

The radial vanes preferably have a stagger angle that is selected such that the angle-of-attack at the upper flow rate is zero. Consequently, positive pressure recovery is achieved across the full range of flow rates.

Advantageously, the stagger angle and the second flow angle are substantially the same. That is to say that the stagger angle is within a degree or two of the second flow angle. The difference between the two angles will depend on the value of the radius ratio. As the radius ratio decreases, any difference between the two angles also decreases.

The difference between the first flow angle and the second flow angle may be as much as 20 degrees.

The difference between the lower flow rate and the upper flow rate may be as much as 7 l/s. Indeed, the compressor preferably operates between a lower flow rate of about 5 l/s and an upper flow rate of about 12 l/s. The compressor thus provides a good range of flow rates over which the diffuser provides positive, stall-free pressure recovery.

The impeller may rotate at speeds in excess of 80 krpm at both the lower flow rate and the upper flow rate. Accordingly, a compact compressor may be realised that provides adequate rates of flow. In particular, the impeller may have a radius of no more than 50 mm. At these speeds, changes in flow rate may result in sizeable changes in flow angle. The diffuser nevertheless provides positive, stall-free pressure recovery over the full range of flow rates.

Advantageously, the impeller is mounted to a shaft, and the shaft is mounted to the diffuser by a bearing cartridge secured to the shaft and the diffuser. This then has the advantage that the impeller may be accurately aligned relative to the diffuser. In particular, the bearing cartridge may be mounted to the diffuser such that the impeller and diffuser are concentric.

BRIEF DESCRIPTION OF THE DRAWINGS

In order that the present invention may be more readily understood, an embodiment of the invention will now be described, by way of example, with reference to the accompanying drawings, in which.

DETAILED DESCRIPTION OF THE INVENTION

Figure 1:
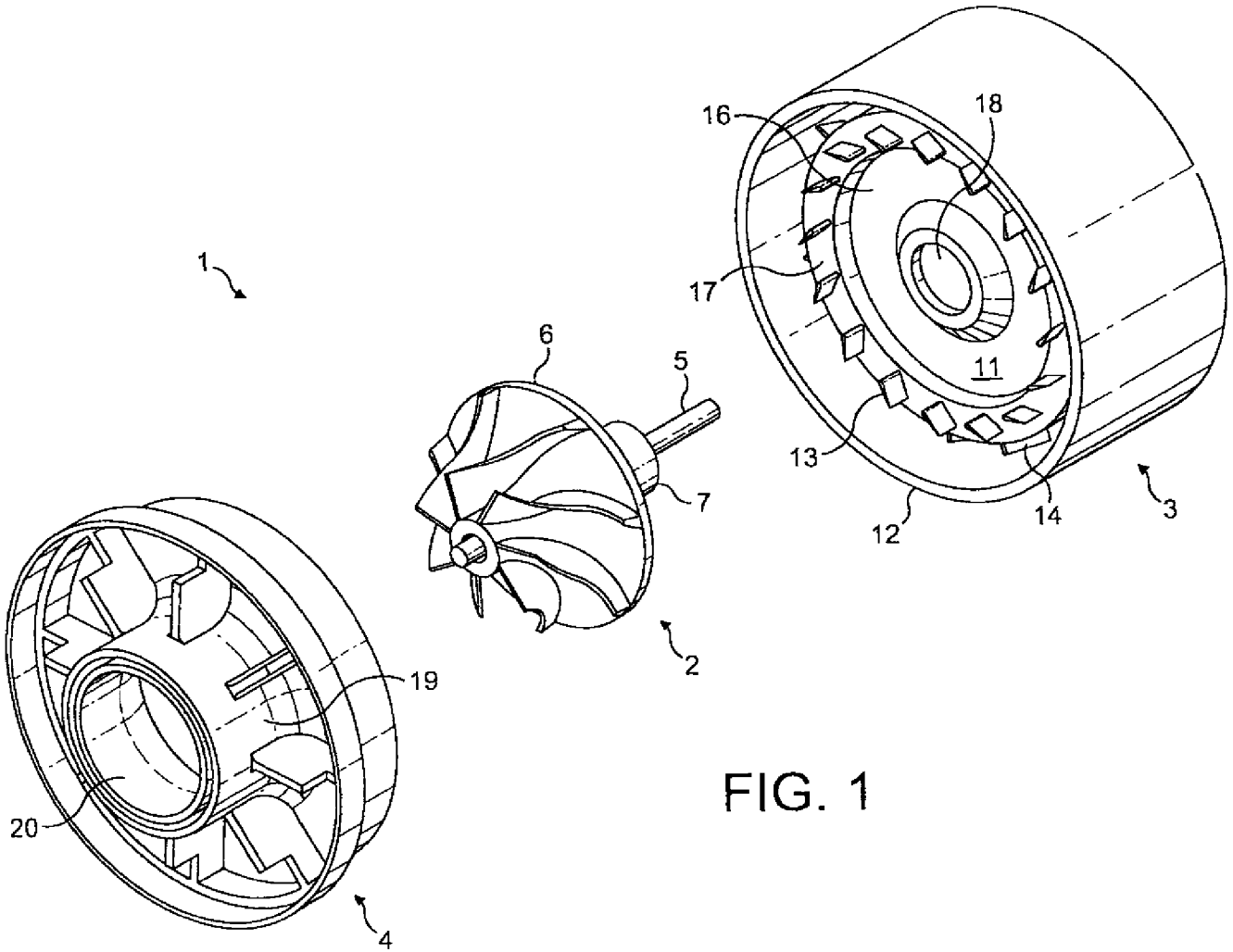
FIG. 1 is an exploded view of a centrifugal compressor in accordance with the present invention.
Figure 2:
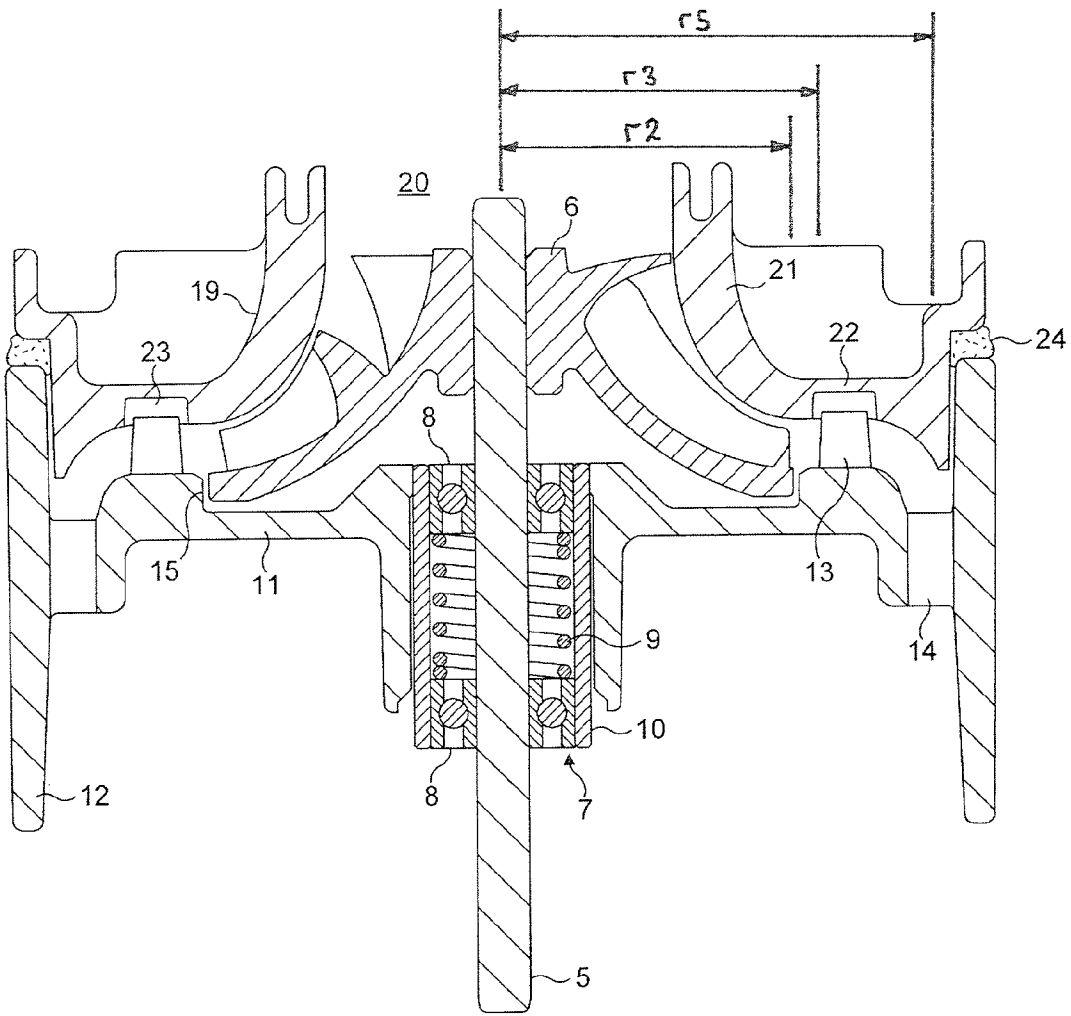
FIG. 2 is a sectional view of the centrifugal compressor of FIG. 1.

The centrifugal compressor 1 of FIGS. 1 and 2 comprises a rotor 2, a diffuser 3, and a shroud 4.

The rotor 2 comprises a shaft 5 to which are mounted an impeller 6 and a bearing cartridge 7. The free end of the shaft 5 is driven by a motor (not shown). The bearing cartridge 7 comprises a pair of spaced bearings 8, preloaded by a spring 9, and surrounded by a sleeve 10.

The diffuser 3 comprises a hub 11, a perimeter wall 12, a plurality of radial vanes 13, and a plurality of axial vanes 14. A step 15 is formed in the upper surface of the hub 11 to define a central portion 16 and an outer annulus 17. The radial vanes 13 are two-dimensional aerofoils spaced circumferentially around the outer annulus 17. The perimeter wall 12 is spaced from and encircles the hub 11. The axial vanes 14 are two-dimensional aerofoils that extend between and secure the perimeter wall 12 to the hub 11. The details of the radial and axial vanes 13,14 are described in further detail below.

The rotor 2 is rotatably mounted to the diffuser 3 by the bearing cartridge 7, which is secured within a central bore 18 in the hub 11 of the diffuser 3. In having a pair of bearings 8 that are spaced apart, the bearing cartridge 7 provides good support for the rotor 2.

The shroud 4 comprises a bell-shaped wall 19 that covers both the impeller 6 and the diffuser 2. The bell-shaped 19 wall includes a central aperture 20 that serves as a fluid inlet, a first portion 21 for covering the impeller 6, and a second portion 22 for covering the diffuser 4. A plurality of recesses 23 are formed around the inner surface of the second portion 22.

The shroud 4 is secured to the perimeter wall 12 of the diffuser 3 by an adhesive 24. A fluid passageway is thus created between the inlet 20 of the shroud 4 and an axial outlet of the diffuser 3. The shroud 4 is secured to the diffuser 3 such that each radial vane 13 projects into a respective recess 23. In so doing, the position of the shroud 4 relative to the impeller 6 may be adjusted to establish a well-defined clearance without creating a radial gap between the shroud 4 and the radial vanes 13.

The compressor 1 operates between a lower flow rate of 5 l/s and an upper flow rate of 12 l/s. At the lower flow rate, the impeller 6 rotates at around 104 krpm and fluid exits the impeller at a flow angle of 77 degrees. At the upper flow rate, the impeller 6 rotates at around 86 krpm and fluid exits the impeller at a flow angle of 57 degrees. As is explained below, the diffuser 3 provides positive stall-free pressure recovery over the full range of flow rates under which the compressor 1 operates. Consequently, the compressor operates optimally across the full range of required flow.

Figure 3:
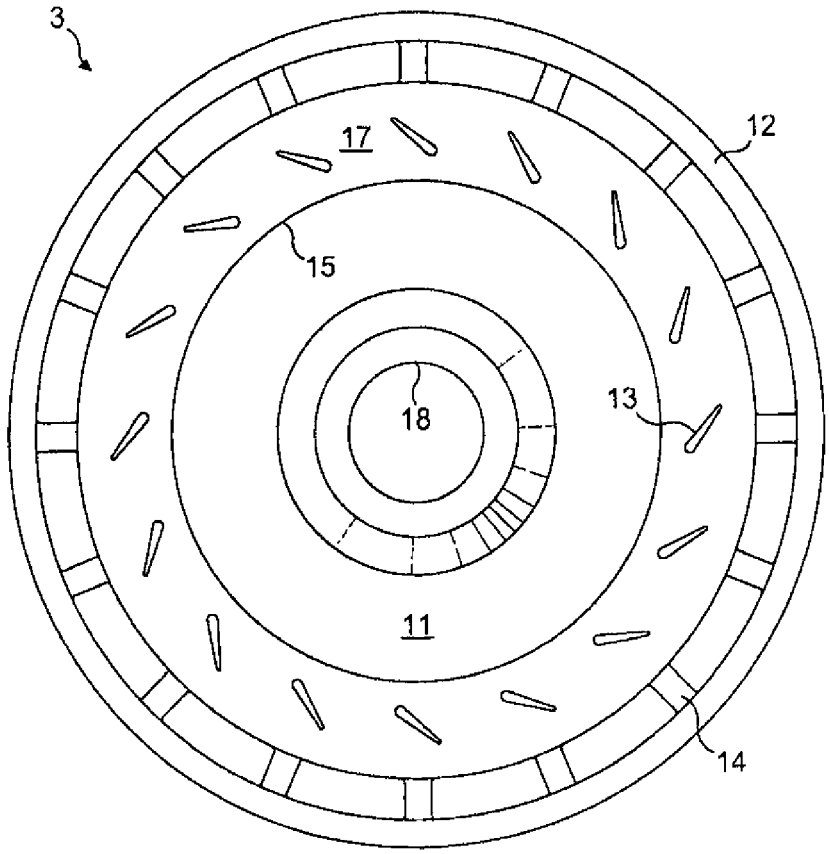
FIG. 3 is a plan view of the diffuser of the centrifugal compressor of FIGS. 1 and 2.

Returning now to the diffuser 3, which is additionally illustrated in FIG. 3, each of the radial and axial vanes 13,14 has a profile that corresponds substantially to a NACA 65-($12A_{10}$)10 aerofoil and thus has a lift coefficient of 12. However, unlike a conventional NACA 65 aerofoil which has a sharp trailing edge, the trailing edge of each radial and axial vane 13,14 has been thickened slightly while maintaining stagger angle. This thickening of the trailing edges enables the diffuser 3 to be manufactured using materials and processes that are otherwise incapable of creating a sharp trailing edge. In particular, the diffuser 3 can be manufactured from a plastic material (e.g. a bulk moulding compound) using moulding processes (e.g. compression or injection moulding).

The radial vanes 13 have a blade count of 16, an inlet solidity of 0.62, a stagger angle of 57 degrees, and a radius ratio of vane inlet to impeller outlet (r3/r2) of 1.10.

The axial vanes 14 have a blade count of 16, an inlet solidity of 0.61, a stagger angle of 25 degrees, an axial length of 25.4 mm and a radius ratio of mean vane inlet to impeller outlet (r5/r2) of 1.46.

With this arrangement of radial vanes 13, the diffuser 3 provides positive, stall-free pressure recovery over a range of flow angles of between 57 and 77 degrees; this corresponds to a range in the angle-of-attack of between 0 and 20 degrees. A flow angle greater than 77 degrees is likely to stall the diffuser, while a flow angle less than 57 degrees results in negative pressure recovery. The diffuser 3 therefore provides positive pressure recovery over a relatively broad operating range of flow angles. Moreover, the pressure recovery coefficient is greatest at the high end of flow angles.

In addition to having a broad operating range of flow angles, the diffuser 3 has a minimum pressure loss at a flow angle of about 55 degrees, corresponding to an angle-of-attack of about 8 degrees. The diffuser 3 is therefore most efficient at a point approximately at the centre of the operating range.

The diffuser 3 therefore provides positive, stall-free pressure recovery over the full range of flow rates under which the compressor 1 operates. In operating optimally across the full range of required flow, the compressor 1 is ideally suited for use in applications that operate over a broad range of flow rates. In particular, the compressor 1 is ideally suited for use in a vacuum cleaner, which typically operates over a broad range of loads and flow rates as the cleaner is manoeuvred over a different floor surfaces, e.g. hard floor, short-pile carpet and long-pile carpet.

The primary function of the axial vanes 14 is to provide a bridge between the hub 11 and the perimeter wall 12 such that the diffuser 3 has an axial outlet. Nevertheless, the axial vanes 14 do contribute, albeit by a small amount, to pressure recovery by further straightening the airflow. The axial vanes 14 do not, however, contribute to the operating range of the diffuser 3 and may therefore be omitted. Indeed, it is not essential that the diffuser 3 has an axial outlet and thus the perimeter wall 12 may also be omitted.

In the embodiment described above, the radial vanes 13 have particular values for blade count, solidity, stagger angle, and inlet radius ratio. This particular selection of values results in positive, stall-free pressure recovery over a range of flow angles of between 53 and 73 degrees, corresponding to an angle-of-attack range of between 0 and 20 degrees. As will now be demonstrated, the blade count, solidity, stagger angle, and radius ratio may nevertheless be varied while continuing to provide positive, stall-free pressure recovery over a relatively broad range of flow angles.

The radius ratio of the vane inlet to impeller outlet (r3/r2) may be varied without any significant change in the operating range. However, as the radius ratio increases, the vaneless region of the diffuser 3 increases and thus the angle-of-attack decreases by a small amount. Consequently, in order that an angle-of-attack of between 0 and 20 degrees is maintained over the operating range of the compressor 1, the stagger angle of the vanes 13 is ideally increased along with the radius ratio. By way of example, if the radius ratio is increased from 1.1 to 1.5, the stagger angle of the blades should ideally be increased by about 1.5 degrees in order that the same angle-of-attack of between 0 and 20 degrees is maintained. Naturally, as the radius ratio increases, the size of the diffuser 3 and thus the compressor 1 increases. Consequently, the radius ratio is preferably no greater than 1.5 and more preferably no greater than 1.2. Accordingly, a compact diffuser 3 and compressor 1 may be realised.

The solidity of the radial vanes 13 has a greater influence on the operating range of the diffuser 3. By increasing the solidity of the vanes 13, the chord length of the vanes 13 increases. As the chord length increases, pressure losses increase, particularly at the low angle end of the operating range. Consequently, at the low angle end of the operating range, pressure recovery becomes negative, thereby reducing the operating range over which positive pressure recovery is achieved. For example, by increasing the solidity of the vanes from 0.62 to 1.00, the operating range over which positive, stall-free pressure recovery is achieved is likely to be reduced by around three degrees, i.e. to between 3 and 20 degrees in terms of angle-of-attack. In order that the radial vanes 13 provide positive, stall-free pressure recovery over a relatively broad operating range, the solidity of the vanes 13 is preferably between 0.6 and 0.8 and more preferably between 0.60 and 0.65.

Varying the blade count also changes the chord length of the radial vanes 13. However, for a solidity of between 0.6 and 0.8, a blade count of between 15 and 20 has little effect on the operating range of the diffuser 3. Decreasing the blade count beyond this range brings about pressure losses that ultimately reduce the operating range over which positive pressure recovery is achieved. As the blade count increases beyond this range, the chord length becomes increasingly short and a limit is reached where the vanes no longer adequately turn the fluid, which in turn causes the fluid to stall at an earlier angle. Accordingly, the radial vanes 13 preferably have a blade count of between 15 and 20.

The stagger angle of the radial vanes 13 is selected in dependence of the flow angle of fluid exiting the impeller 6 at the upper flow rate. In particular, the stagger angle is selected such that the angle-of-attack of fluid at the radial vanes 13 is zero at the upper flow rate. For the compressor 1 described above, the flow angle of fluid exiting the impeller 6 at the upper flow rate is 57 degrees, and thus a stagger angle of 57 degrees is selected for the radial vanes 13. However, should fluid exit the impeller 6 at a different flow angle at the upper flow rate, then the stagger angle of the vanes 13 may be varied accordingly. For speeds in excess of 80 krpm, the speed of rotation and backsweep of the impeller 6 is such that fluid is likely to exit the impeller 6 at an angle of between 50 and 65 degrees at the upper flow rate. Accordingly, the stagger angle of the radial vanes 13 is ideally between 50 and 65 degrees.

The diffuser of the present invention provides positive, stall-free pressure recovery over a relatively broad operating range. This is achieved using fixed-geometry vanes and thus the diffuser is cheaper and more robust than an equivalent variable-geometry diffuser. In providing stall-free pressure recovery over a relatively broad operating range, the diffuser is ideally suited for use with high-speed compressors (i.e. operating at speeds in excess of 80 krpm), which operate under a range of loads and flow rates. By including the diffuser in a high-speed compressor, a more compact compressor may be realised. In particular, the compressor may comprise an impeller having a radius of no more than 50 mm. Although the impeller is then relatively small, the relatively high speed of rotation of the impeller (i.e. in excess of 80 krpm) means that adequate flow rates are nevertheless achievable.

The invention claimed is:

1. A centrifugal compressor comprising an impeller and a diffuser, wherein the compressor operates between a lower flow rate and an upper flow rate, fluid exits the impeller at a first flow angle at the lower flow rate and at a second flow angle at the upper flow rate, the difference between the first flow angle and the second flow angle is around 20 degrees, and the diffuser comprises a plurality of radial vanes having a blade count of between 15 and 20, a solidity of between 0.6 and 0.8, and a radius ratio of vane inlet to impeller outlet of less than 1.5 so as to provide positive stall-free pressure recovery between the lower flow rate and the upper flow rate.

2. The compressor of claim 1, wherein the radial vanes have a stagger angle selected such that the angle-of-attack at the upper flow rate is zero.

3. The compressor of claim 2, wherein the stagger angle and the second flow angle are substantially the same.

4. The compressor of claim 1, wherein the difference in the lower flow rate and the upper flow rate is about 7 l/s.

5. The compressor of claim 4, wherein the lower flow rate is about 5 l/s and the upper flow rate is about 12 l/s.

6. The compressor of claim 1, wherein the second flow angle is between 50 and 65 degrees.

7. The compressor of claim 1, wherein the impeller rotates at speeds in excess of 80 krpm at both the lower flow rate and the upper flow rate.

8. The compressor of claim 1, wherein the radius of the impeller is no more than 50 mm.

9. The compressor of claim 1, wherein the impeller is mounted to a shaft, and the shaft is mounted to the diffuser by a bearing assembly directly secured to the shaft and the diffuser.

10. The compressor of claim 1, wherein the solidity is between 0.60 and 0.65.

11. The compressor of claim 1, wherein the radius ratio is less than 1.2.

12. The compressor of claim 1, wherein the vanes have a stagger angle between 50 and 65 degrees.

13. The compressor of claim 1, wherein the diffuser comprises a hub, a perimeter wall that encircles the hub and a plurality of axial vanes, and wherein the radial vanes are provided on an upper surface of the hub, and the axial vanes extend between the hub and the perimeter wall.

14. A vacuum cleaner comprising a centrifugal compressor comprising an impeller and a diffuser, wherein the compressor operates between a lower flow rate and an upper flow rate, fluid exits the impeller at a first flow angle at the lower flow rate and at a second flow angle at the upper flow rate, the difference between the first flow angle and the second flow angle is around 20 degrees, and the diffuser comprises a plurality of radial vanes having a blade count of between 15 and 20, a solidity of between 0.6 and 0.8, a radius ratio of vane inlet to impeller outlet of less than 1.5 so as to provide positive stall-free pressure recovery between the lower flow rate and the upper flow rate.

* * * * *